US008505844B2

(12) United States Patent
Chen et al.

(10) Patent No.: US 8,505,844 B2
(45) Date of Patent: Aug. 13, 2013

(54) METHOD FOR OPERATING A WINDING MACHINE

(75) Inventors: Qing Chen, Fürth-Stadeln (DE); Jörg Reh, Möhrendorf (DE)

(73) Assignee: Siemens Aktiengesellschaft, München (DE)

( * ) Notice: Subject to any disclaimer, the term of this patent is extended or adjusted under 35 U.S.C. 154(b) by 1219 days.

(21) Appl. No.: 11/992,144

(22) PCT Filed: Aug. 3, 2006

(86) PCT No.: PCT/EP2006/065001

§ 371 (c)(1),
(2), (4) Date: Mar. 17, 2008

(87) PCT Pub. No.: WO2007/031368

PCT Pub. Date: Mar. 22, 2007

(65) Prior Publication Data

US 2009/0271040 A1 Oct. 29, 2009

(30) Foreign Application Priority Data

Sep. 16, 2005 (DE) ..... 10 2005 044 339

(51) Int. Cl.
*B65H 23/18* (2006.01)

(52) U.S. Cl.
USPC ..... 242/412.2; 242/413.1; 242/478.2

(58) Field of Classification Search
USPC ..... 242/412.2, 413, 413.1, 478.2
See application file for complete search history.

(56) References Cited

U.S. PATENT DOCUMENTS

| | | | | | |
|---|---|---|---|---|---|
| 4,214,717 | A | * | 7/1980 | Makino et al. | 242/484.9 |
| 4,880,175 | A | * | 11/1989 | Yamauchi et al. | 242/412.1 |
| 4,964,582 | A | * | 10/1990 | Hermanns et al. | 242/485.1 |
| 4,984,749 | A | * | 1/1991 | Matsui et al. | 242/410 |
| 5,074,481 | A | * | 12/1991 | Kathke | 242/478.2 |
| 5,111,986 | A | * | 5/1992 | Niemann | 242/419.9 |
| 5,301,887 | A | * | 4/1994 | Wirtz et al. | 242/412.1 |
| 5,437,417 | A | * | 8/1995 | Kammann | 242/541.1 |
| 5,577,676 | A | * | 11/1996 | Berger et al. | 242/478.2 |
| 6,659,386 | B1 | * | 12/2003 | Rienas | 242/478.2 |
| 6,828,743 | B2 | * | 12/2004 | Debuf | 242/413.1 |
| 2004/0245363 | A1 | * | 12/2004 | Vaeth | 242/417 |

FOREIGN PATENT DOCUMENTS

| | | | |
|---|---|---|---|
| DE | 3002997 | A1 | 9/1980 |
| DE | 4019140 | A1 | 12/1991 |
| DE | 4326187 | A1 | 2/1994 |
| DE | 19531692 | A1 | 4/1996 |
| DE | 19735581 | A1 | 2/1999 |
| DE | 19848881 | A1 | 4/2000 |
| DE | 19905860 | A1 | 8/2000 |
| DE | 10014813 | A1 | 10/2001 |
| DE | 10135542 | A1 | 2/2003 |
| DE | 102005022448 | A1 | 11/2006 |
| EP | 0717001 | A1 | 6/1996 |
| EP | 0875479 | A1 | 11/1998 |
| JP | 08268612 | A | 10/1996 |

* cited by examiner

*Primary Examiner* — William A Rivera

(57) ABSTRACT

Described is a method for operating a winding machine used for winding up and/or unwinding a winding material, said winding machine comprising a device for controlling and/or regulating the winding process. A variable value is monitored that concerns a machine state and/or a change in the winding material, and at least one parameter of said controlling and/or regulating device is modified in accordance with the change identified.

4 Claims, 2 Drawing Sheets

METHOD FOR OPERATING A WINDING MACHINE

CROSS REFERENCE TO RELATED APPLICATIONS

This application is the US National Stage of International Application No. PCT/EP2006/065001, filed Aug. 3, 2006 and claims the benefit thereof. The International Application claims the benefits of German application No. 10 2005 044 339.7 DE filed Sep. 16, 2005, both of the applications are incorporated by reference herein in their entirety.

FIELD OF INVENTION

The present invention relates to a winding machine and a method for operating a winding machine. Winding machines are used for winding and/or unwinding at least one winding material. The winding material is for example at least a textile thread, a textile web, a fabric web, a wire or the like.

BACKGROUND OF INVENTION

Controllers such as e.g. a PID controller are used for controlling a winding operation, the winding operation relating either to the winding or to the unwinding of the winding material. Owing to the characteristics of the controllers used, a winding machine that has been placed into operation is optimized for precisely one mode of operation and/or type of material and/or for a specific set of machine states. Changes to the characteristics of the winding material such as e.g. type, format, thickness, density, etc., and/or changes to the state of the winding machine such as e.g. temperature, wear, friction, operating mode, etc. result in the need to adjust and also re-optimize parameter settings. Parameters are for example parameters of a controller, such as e.g. the gain of a PID controller. The parameters required for re-optimization can relate, for example, to the drive of the winding machine or also to its controller. Malfunctions, whether of sporadic or recurring origin, can also affect the winding operation. An incorrect or inaccurate optimization and/or malfunctions can result in e.g. the winding quality and/or the productivity of the winding machine being negatively affected. In this case the productivity also relates to e.g. quantity as well as quality.

In the event that, for example, the material of the winding material changes or that a state parameter (temperature, friction, etc.) of the winding machine changes, an adjustment or optimization of at least one of the parameters used in each case is necessary. For this purpose experienced personnel are required, but in many cases these are not located at the installation site of the winding machine. An additional engineering service that may be necessary increases the costs of operating the winding machine. It is also disadvantageous that downtimes that are necessary for optimizing or adjusting parameters as part of a recommissioning operation result in a production outage which again increases the operating costs of the winding machine.

According to the prior art, sporadic faults or even recurrent faults, such as e.g. an out-of-roundness of a material (e.g. a cylinder), can also be circumvented or alleviated by means of a mechanical solution. An example of a mechanical solution is the use of a dancer. In many cases malfunctions can also be avoided for example by reducing the speed of the winder. However, this has the disadvantage of a reduction in productivity. A deterioration in quality can also accompany the speed reduction.

SUMMARY OF INVENTION

An object of the present invention is therefore to disclose a winding machine and a winding method by means of which the above-described disadvantages are at least reduced. The effect of interference factors on the winding machine or winding method is therefore at least to be reduced.

According to the invention this object is achieved by means of a method having the features recited in an independent claim. Further advantageous and inventive developments of the invention may be derived from the embodiments according to the features of the dependent claims.

In an inventive method for operating a winding machine for winding and/or unwinding a winding material, wherein the winding machine has a device for controlling and/or regulating the winding operation, a variable value is monitored. The variable value relates for example to a machine state of the winding machine and/or to a change in a parameter, which change relates to the winding material itself. At least one parameter of the controlling and/or regulating device is modified as a function of the identified change in the variable value. Examples of variable values are the thickness of the winding material, the coefficient of friction of the winding material, or e.g. also a change in operating mode of the winding machine, resulting for example in a change in tractive force. In this case the tractive force is an example of a variable value which relates to a machine state.

Automatic identification of changes or controls is made possible for example by means of continuous load monitoring or a corresponding analysis of the load. For this purpose, in particular additional sensors can be used, such as, for example, a sensor for measuring the tractive force exerted on the winding material.

Advantageously, a dynamic adjustment of a parameter or a corresponding compensation inside a controller and/or regulator of the winding machine is performed if necessary. This serves to ensure that the winding machine can always be operated in an optimal operating state.

Advantageously, the result of carrying out the method according to the invention is a reduction in the downtimes of the winding machine. The productivity of the winding machine can be increased by means of automatic adjustment of the control and/or regulating parameters relating to the machine. Furthermore, the servicing and maintenance overhead is advantageously minimized, while the engineering otherwise necessary for this can also be reduced.

A further advantage of the method according to the invention also results e.g. from the fact that the quality and quantity can be increased in the case of the winding machine owing to the automatic adjustment of at least one parameter of the controlling and/or regulating device and that there is a reduction in the number of fault situations. Thanks to the method according to the invention the winding machine can be deployed in a more autonomous manner.

In addition to the winding machine, the method according to the invention also relates to other mechatronic processes, for example a rolling feed or a synchronization.

In a further advantageous embodiment of the method, the change to a parameter of the device for controlling and/or regulating the winding machine is determined by means of an observer analysis. The observer analysis is performed by means of an observer, the observer simulating at least a part of a closed-loop controlled system of the winding machine. A more precise regulation or control of the winding machine can be achieved through the use of the observer. This relates in particular to changes in boundary conditions which can affect the control behavior. This relates for example to boundary conditions such as the thickness or width of the winding material.

In a further advantageous embodiment of the method a recurring fault is identified, a periodic compensation of the fault being determined by means of the observer analysis. The fault relates for example to a worn bearing, resulting in an eccentric motion of a take-up roller for the winding material.

According to the invention at least one of the following parameters can advantageously be changed:

a rotational speed of the take-up roller, the diameter of the take-up roller, the diameter changing as a function of the progress of the winding operation or as a function of the size of the take-up roller used, a moment of friction relating for example to the friction of the winding material on a guide roller, or also a moment setpoint value for the exerting of a tractive force on the winding material.

The change to a parameter of the above kind is carried out in particular when a limit value is exceeded. The limit value relates for example to the difference between a setpoint value and an actual value, the value relating for example to a position, a tractive force, a moment or a rotational speed.

In a further advantageous embodiment of the method a cause for the changes to the monitored variable value is determined based on the identified changes. This can advantageously be used in particular to facilitate troubleshooting.

BRIEF DESCRIPTION OF THE DRAWINGS

The exemplary embodiments described in more detail below represent preferred embodiments of the present invention, the accompanying figures showing.

DETAILED DESCRIPTION OF INVENTION

Figure 1:
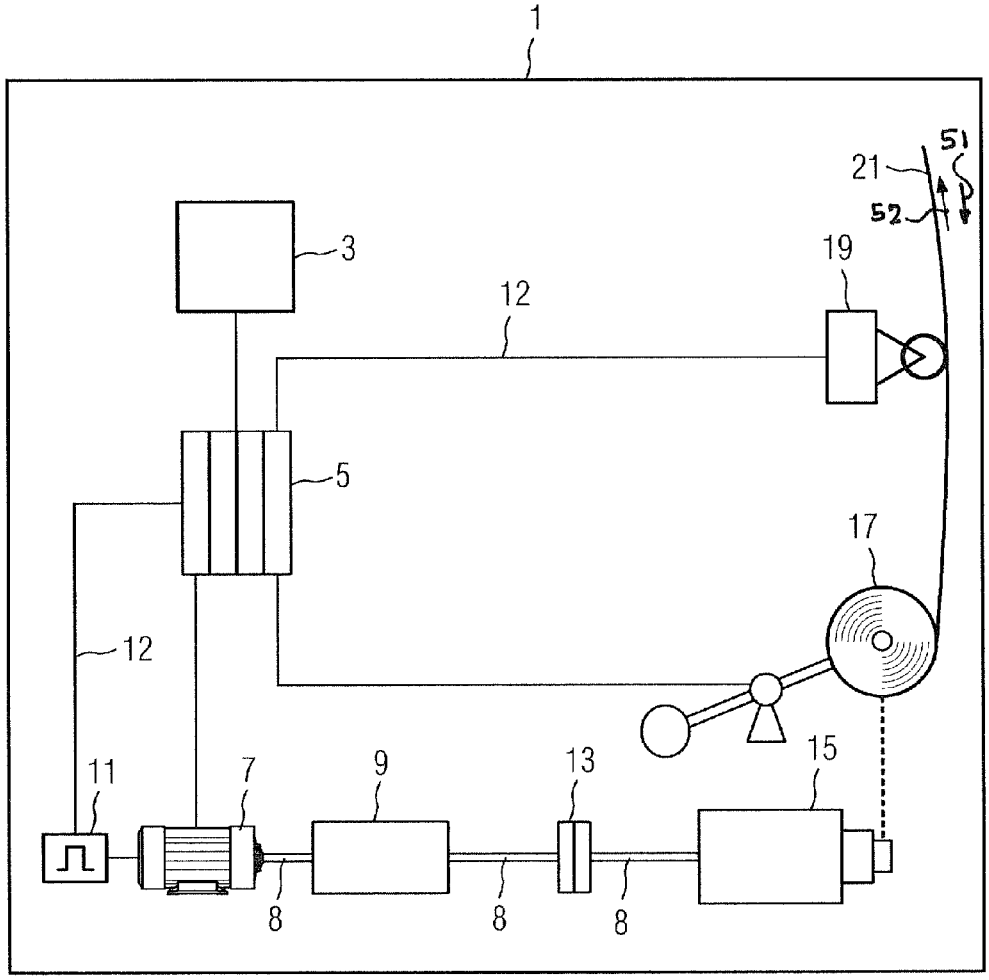
FIG. 1 a schematic representation of the structure of a winding machine.

The schematic according to FIG. 1 shows a winding machine 1 which has a controller 5. The controller 5 is provided for controlling and/or regulating tasks, a current converter also being integrated in said device. The current converter, which is in particular an inverter, is connected to an electric motor 7, a shaft 8 of the electric motor 7 being linked to a transmission 9. The rotational speed of the electric motor 7 is measured by means of a sensor 11 and returned to the controller 5 by means of a data line 12. The transmission 9 is mechanically linked to a clutch 13, the clutch 13 also being connected to a winding shaft 15. A winding or, as the case may be, unwinding of a winding material 21 is effected for example by way of a changing device 17. In the embodiment depicted in FIG. 1, a winding operation is depicted by the arrow lead 51, while an unwinding operation is depicted by the arrow lead 52. The tractive force acting on the winding material, meaning in this example the winding material 21, can be measured by means of a traction measuring device 19, the measured signal being routed to the controller 5 by means of a data line 12 for the purpose of regulating the tractive force. The winding machine 1 can be controlled by, for example, an operator by way of an HMI (Human Machine Interface) 3. By monitoring the load inside the controller 5 it is advantageously possible to provide automatic identification of the changes and/or faults in the case of the winding machine. From this, a dynamic adjustment of parameters of the controller 5 is advantageously performed during the operation of the winding machine 1. This results in a compensation, for example, for external interference factors or, as the case may be, changes in the winding material 21, so that a new startup of the winding machine or an optimization of the winding process necessary by an operator of the winding machine is rendered superfluous.

Figure 2:
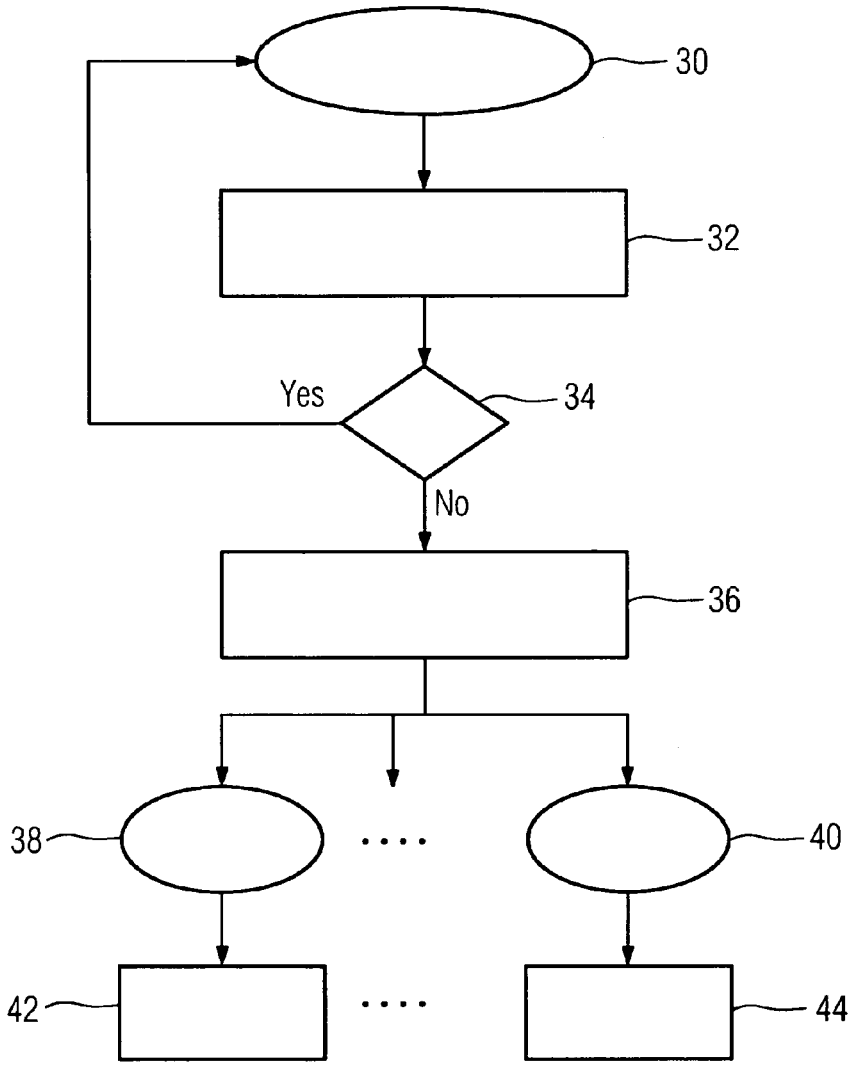
FIG. 2 a schematic flowchart for the structure of an observer.

The schematic according to FIG. 2 shows the structure of an observer in the form of a flowchart. In a first method step 30, for example, actual values of the winding process are recorded and/or also actual values of material states of the winding material. In a further method step 32, the actual values or material states are monitored and setpoint and actual values compared. This comparison is evaluated in a next step 34. If the result of the evaluation 34 is that the winding machine is operating correctly, the evaluation is terminated with Yes and further monitoring of the actual values and material states continues. However, if the evaluation is negative, an analysis 36 of the deviations is performed in a further step 36. Based on the analysis 36, causes 38, 40 for deviations can be derived. Depending on the identified cause 38, 40, measures 42, 44 for rectifying the deviations are subsequently proposed or, as the case may be, taken.

Parameters can be dynamically adjusted in an automated manner by means of automatic identification of changes or malfunctions of the winding machine during the latter's operation. The parameter adjustment relates for example to the compensation for interference signals. The identifying of changes to a monitored variable value relates for example to the material of the winding material or to the state of the winding machine itself. The changes in respect of the material relate for example to at least one of the following variables:

the width, wherein the width can be measured automatically for example by means of one or more Bero sensors, wherein the measured signal(s) is (are) evaluated automatically and used to adjust data-related parameters;

an initial diameter, wherein the initial diameter is determined by means of a sensor or by calculation and this value of the initial diameter is written directly to the position of the parameter for the initial diameter; the calculation is performed for example with the aid of geometry and a sensor for a changing device or by means of a photoelectric barrier;

thickness, wherein where applicable the material thickness of the winding material is required for calculating the diameter; the change in thickness is measured by a sensor and forwarded to the corresponding position, a change in density (weight) of the winding material during operation, wherein automatic density correction is performed repeatedly through analysis of the traction control output signal.

The variable value can also relate to a value which refers to the machine state, values of this kind being for example:

Temperature;

from this there results in particular a change in friction, against which appropriate measures should be introduced, or a change in the elasticity of a material or in the thickness of the material and/or a change in density, Wear;

from this there results e.g. a change in friction,

Change of operating mode;

the parameter set or an interconnection (via BICO technology) can be switched over via a corresponding control signal, Measure against change in friction;

normally the winding machine operates with friction or compensation characteristic curves, the output of the speed controller having a deviation of approx. less than 2%.

An adjustment to a friction characteristic curve can be carried out by means of an observer analysis with the aid of the monitoring of the speed controller (Ausgang_n_Regler) or by comparison of the change in moment M with the change in the moment of friction (dM/dt< >dM_Reib/dt).

Faults relating to the winding machine can be identified by measuring corresponding signals and comparing them with setpoint values, in which case appropriate countermeasures can be taken after a fault has been identified. Examples of countermeasures of this kind are indicated below.

A periodic compensation is performed in the case of recurring faults, such as occur for example in the case of eccentricity. For this purpose, the actual values for, for example, the position, the tractive force, the current, the moment, and/or the diameter over time or the speed over time are measured and subjected to an observer analysis, with a periodic compensation being calculated.

With sporadic faults, compensations are performed at intervals, with in particular control signals of the winding machine controller being taken into account in the case of faults of this kind in particular in addition to the signals measured in the case of recurring faults (position actual value, tractive force actual value, current actual value, moment actual value, diameter over time or speed over time).

In principle the observer can be embodied for an observer analysis in such a way that in an optimal operating state (e.g. at a constant speed of a web movement and/or in an automated winding operation mode) at least one of the changes described below can be identified by calculation or learning:

$d(n)/dt$=change in the rotational speed $d(D)/dt$=change in the diameter $K*d(n)/dt$ $D(M_\text{Reibung})/dt$=change in the moment of friction $(M_\text{Soll})/dt$=change in the moment setpoint value.

A continuous load monitoring analysis is possible based on the actual values (e.g. the position actual value, the tractive force actual value, the moment actual value or the speed actual value) and the derived actual values (dn/dt, dD/dt and dM/dt . . . ). Should one or more of the above-mentioned variables be exceeded, an appropriate measure (e.g. parameter adjustment or a moment compensation) is advantageously performed automatically.

The invention claimed is:

1. A method for operating a winding machine, comprising:

providing a controller to control the winding;

monitoring a set of variable values related to a change of a winding material and to a change of a state of the winding, wherein a first variable value is a tractive force acting on the winding material that is sensed by a traction measuring device, wherein at least one second variable value is selected from the group consisting of a thickness of the winding material and a coefficient of friction of the winding material;

identifying a fault condition caused by an external interference signal, based on a determined change of at least one the variable values; and modifying a parameter of the controller when a fault condition is identified, wherein the modification of the of the controller parameter provides a compensation for the external interference signal.

2. The method as claimed in claim 1, wherein the parameter to be changed is changed if a limit is exceeded.

3. The method as claimed in claim 2, wherein the limit is a tractive force.

4. The method as claimed in claim 1, wherein a cause for the change in the monitored variable quantity is determined.

* * * * *